United States Patent [19]

Kato et al.

[11] Patent Number: 4,860,565

[45] Date of Patent: Aug. 29, 1989

[54] PROCESS FOR PREPARING HOLLOW ALUMINUM EXTRUDATES FOR USE IN VACUUM

[75] Inventors: Yutaka Kato; Eizo Isoyama, both of Sakai, Japan

[73] Assignee: Showa Aluminum Corporation, Osaka, Japan

[21] Appl. No.: 205,777

[22] Filed: Jun. 13, 1988

[30] Foreign Application Priority Data

Jun. 15, 1987 [JP] Japan ..... 62-149910

[51] Int. Cl.[4] ..... B21C 23/00

[52] U.S. Cl. ..... 72/38; 72/253.1; 72/269

[58] Field of Search ..... 72/38, 39, 253.1, 254, 72/255, 258, 265, 269, 271

[56] References Cited

U.S. PATENT DOCUMENTS 4,578,973 4/1986 Ishimaru et al. ..... 72/38

*Primary Examiner*—E. Michael Combs

*Attorney, Agent, or Firm*—Armstrong, Nikaido, Marmelstein, Kubovcik & Murray

[57] ABSTRACT

A process for preparing a hollow aluminum extrudate for use in a vacuum characterized in that dry air or pure oxygen is supplied to the hollow portion of the shaped material being extruded. During the extrusion, the inner surface of the extrudate defining the hollow portion is held out of contact with the atmospheric air containing water to form a compact oxide coating on the inner surface without permitting formation of any hydrated oxide coating.

8 Claims, 2 Drawing Sheets

PROCESS FOR PREPARING HOLLOW ALUMINUM EXTRUDATES FOR USE IN VACUUM

BACKGROUND OF THE INVENTION

The present invention relates to a process for preparing hollow aluminum extrudates for use in a vacuum, and more particularly to a process for preparing hollow aluminum extrudates for use in a high vacuum, such as particle accelerating pipes for use in synchrotrons and like accelerators.

The term "aluminum" as used herein includes pure aluminum and alloys thereof.

Although particle accelerating pipes of the type mentioned were primarily made of stainless steel, aluminum has recently been found suited to this use and introduced into use because as compared with stainless steel, aluminum is less likely to induce radioactivity, more rapidly attenuates the radioactivity induced, is higher in heat and electric conductivities, has a surface which is lower in outgassing rate, is more lightweight and has higher workability.

The interior of the particle accelerating pipe must be maintained on a high vacuum for passing particles therethrough at a high speed. Accordingly, what matters is how to evacuate the pipe to a high vacuum. In order to maintain the interior of the particle accelerating pipe in a high vacuum, it is important to diminish the release of gases from the inner wall of the pipe as produced. For diminishing the release of gases from the inner surface of particle accelerating pipes of aluminum, it has been found effective to form a compact and thin coating on the surface.

The compact thin coating is effective for diminishing the release of gases for the following reason. As is well known, aluminum is a metal which is very susceptible to oxidation, such that an oxide coating is formed on the surface merely when it is brought into contact with a very small amount of oxygen. On the inner surface of an aluminum pipe extruded by the usual process, a hydrated oxide coating, such as boehmite or bialite film, is formed upon extrusion by contact with the watercontaining atmospheric air. Moreover, since the pipe being extruded is exposed to a high temperature, the coating forming reaction is accelerated to give a large thickness to the coating. Unlike the aluminum oxide coating which is formed in the absence of water, the hydrated oxide coating has an exceedingly rough texture, is porous and has pores of intricate form. The coating absorbs a large quantity of water because it is thick. After the extrusion, moreover, the coating, which is not compact, absorbs from the atmosphere substances which lower the degree of vacuum, such as water, hydrocarbons, carbon dioxide and carbon monoxide. Such vacuum reducing substances are still present in small quantities when the pipe is cleaned by an electric discharge in hydrogen gas, argon gas, oxygen gas or the like, when it is degassed with heating or when it is evacuated, so that these substances are adsorbed by the coating similarly and become difficult to remove even by evacuation. Consequently, these substances present difficulties in giving a higher vacuum to the particle accelerating pipe. To impart enhanced mechanical strength to the extruded aluminum pipe, the pipe is heated to a high temperature and then cooled in water and air for hardening. During this process, the hydrated oxide coating formed during the extrusion further grows, while the vacuum reducing substances already adsorbed become occluded by the coating. The compact thin coating is exceedingly smaller than the thick hydrated oxide coating of rough texture in the amounts of vacuum reducing substances adsorbed or occluded. Even if adsorbed or occluded, these substances are readily removable by a degassing treatment. Consequently, the amounts of such substances to be released into the pipe are greatly decreased.

A process is already known for producing a hollow aluminum extrudate formed with a compact thin oxide coating on its inner surface for use in a vacuum (see U.S. Pat. No. 4,578,973). This process is characterized in that an oxygen-containing inert gas serving as impurities is supplied to the hollow portion of the shaped material being extruded to form the compact thin oxide coating on the inner surface of the extrudate with the oxygen contained in the inert gas.

However, the process has the problem of a high production cost because the inert gas is expensive.

SUMMARY OF THE INVENTION

The main object of the present invention is to overcome the foregoing problems and to provide a process for inexpensively producing hollow aluminum extrudates for use in a vacuum, for example, those suited to use as particle accelerating pipes which must be maintained in a vacuum in the interior.

The present invention provides a process for preparing a hollow aluminum extrudate for use in a vacuum characterized in that dry air or pure oxygen is supplied to the hollow portion of the shaped aluminum material being extruded.

With the process of the present invention, dry air or pure oxygen is supplied to the hollow portion of the shaped aluminum material being extruded, so that the inner surface of the hollow extrudate is held out of contact with the atmospheric air containing water to preclude the formation of the undesired hydrated oxide coating on the inner surface, permitting the oxygen in the dry air or pure oxygen supplied to form an oxide coating on the inner surface. The oxide coating has a compact texture and a small thickness, is therefore extremely less likely to adsorb or occlude vacuum reducing substances unlike the hydrated oxide coating, permits such substances, if any, to be readily removed by a degassing treatment and is accordingly greatly diminished in the quantities of such substances to be released into the pipe. Consequently, the interior of the pipe can be maintained in a high vacuum while obviating or reducing the need for a cumbersome procedure conventionally employed for increasing the degree of vacuum. Moreover, dry air or pure oxygen, which is less expensive than the inert gas, renders the present process less costly than the conventional process wherein the inert gas is used.

DESCRIPTION OF THE PREFERRED EMBODIMENTS

The billets to be used for preparing extrudates according to the invention are preferably those of Al-Mg-Si alloys, such as AA6061 and AA6063, in view of the extrudability and mechanical strength.

More preferably, the billet is one comprising a core of pure aluminum and a cladding of the abovementioned Al-Mg-Si alloy. When this billet is used, the hollow extrudate obtained is internally covered with pure aluminum, has the desired mechanical strength and can be reduced in the electric resistance of its inner layer at cryogenic temperatures as at the temperature of liquid helium. If the electric resistance is great at cryogenic temperatures, the following problem is encountered. Presently, the beam to be propagated through particle accelerating beam chambers has energy of about 30×30 GeV, so that the wall current flowing along the inner wall surface of the chamber is not very great, permitting the beam to remain stable even if the electric resistance of the alloy is not very small at cryogenic temperatures. However, it is intended to increase the energy of the beam to be propagated through the chamber to about 20000×20000 GeV. If the beam energy is as high as this level, the wall current will increase. If the electric resistance is great when the wall current is great, the beam becomes unstable. The high-purity aluminum to be used for the billet is preferably at least 99.9%, more preferably at least 99.99%, in purity.

The dry air to be supplied can be obtained, for example, by compressing atmospheric air by a compressor and then passing the air through a dehumidifier containing a drying agent. While known drying agents are usable for this method, it is desirable to use synthetic zeolite. The dry air is preferably up to −30° C., more preferably up to −50° C., in dew point. Pure oxygen free from water is oxygen having a purity of 100%.

Dry air or pure oxygen, when supplied to the hollow portion of the extrudate being produced, forms an oxide coating having a thickness of about 20 to about 30 angstroms on the inner surface of the extrudate.

The hollow extrudate obtained by the process of the invention is usable not only for a particle accelerating pipe but also for a product which needs to be maintained in a high vacuum.

The process of the invention will be described below with reference to the drawings merely for illustrative purposes.

Figure 1:
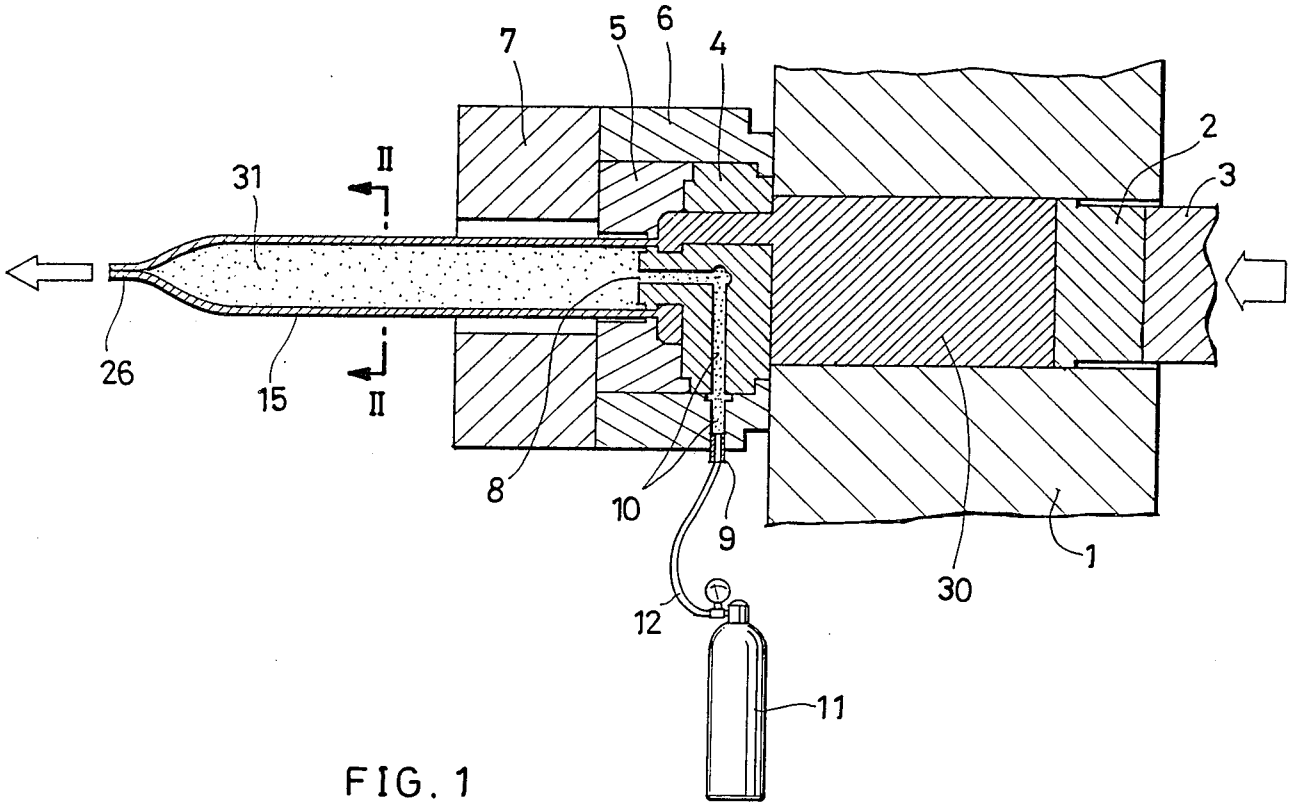
FIG. 1 is a view in vertical section showing a hollow aluminum extrudate being formed.

FIG. 1 shows an extruder which includes a known container 1, dummy block 2, stem 3, porthole male die 4, porthole female die 5, die holder 6 and bolster 7. The male die 4 is centrally formed with a gas injection outlet 8. The die holder 6 and the male die 4 are formed with a gas channel 10 which extends from a gas supply inlet 9 formed in the lower end of the holder 6 to the gas injection outlet 8. The supply inlet 9 has connected thereto the forward end of a conduit 12 attached to a gas container 11.

Figure 3:
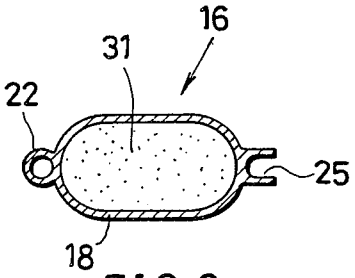
FIG. 3 is a sectional view corresponding to FIG. 2 and showing another extrudate for use in combination with the extrudate of FIG. 2 for preparing a particle accelerating pipe.
Figure 2:
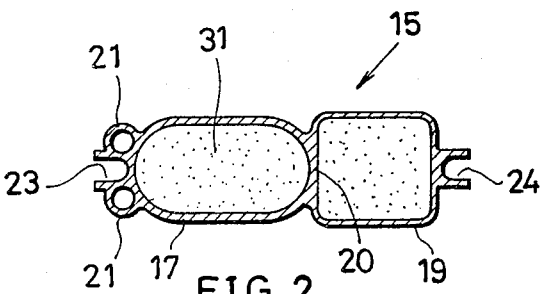
FIG. 2 is an enlarged view in section taken along the line II—II in FIG. 1.

The extruder shown in FIG. 1 produces hollow extrudates 15 and 16 respectively shown in FIGS. 2 and 3 in cross section for use in fabricating a particle accelerating pipe. The dies for forming these extrudates are of course shaped in conformity with the configurations of the respective extrudates 15, 16. Such extrudates 15, 16, each having a specified length, are joined to one another as arranged alternately into the particle accelerating pipe (not shown) which is endless. The extrudates 15, 16 for the accelerating pipe have hollow wall portions 17, 18, respectively, which are generally elliptical in cross section for passing particles therethrough (when assembled into the accelerating pipe, as hereinafter described). The extrudate 15 is provided with an evacuating hollow wall portion 19 adjacent to the particle passing hollow wall portion 17 and having a square cross section. The partition wall 20 between the two hollow wall portions 17, 19 is formed with communication apertures (not shown) at a specified spacing. The particle passing hollow wall wall portions 17, 18 are formed, each at its one side, with cooling water passing hollow wall portions 21, 22, respectively, of small circular cross section, two hollow wall portions 21 for the extrudate 15 and one hollow wall portion 22 for the other extrudate 16. The extrudate 15 has grooves 23, 24 for attaching a sheathed wire for degassing heat treatment between the two cooling water passing hollow wall portions 21 and on one side of the evacuating hollow wall portion 19, respectively. The other extrudate 16 has a similar groove 25 on the other side of the hollow portion 18.

Figure 4:
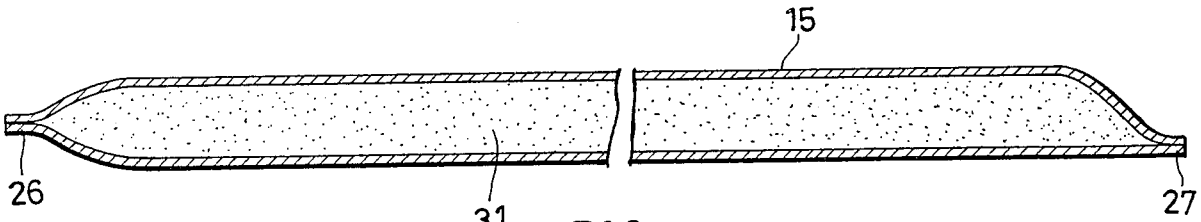
FIG. 4 is a view in longitudinal section of an extrudate having a gas mixture enclosed therein.

The process for producing the hollow extrudate 15 will be described stepwise. The gas container 11 has contained therein dry air having a dew point of −70° C. The dies are washed with a caustic agent, and a billet 30 of AA6063 subjected to homogenizing treatment at 560° C. for 3 hours is then extruded at a temperature of 500° C. at a rate of 10 m/min without using any lubricant. Simultaneously with this operation, the dry air 31, −70° of C. in dew point, is supplied from the gas container 11 to the injection outlet 8 via the conduit 12 and the channel 10 and injected at a pressure of 2 to 3 $kg/cm^2$ into the hollow portion of the extrudate 15 being formed. The open forward end of the extrudate 15 as extruded by a small length is sealed off by being compressed with a press to form one sealed end portion 26 as seen in FIG. 1. The dry air 31 is thereafter continuously supplied, and a predetermined length of extrudate 15 formed is cut off by a shear, whereupon the cut end is sealed off to form the other sealed end portion 27 (see FIG. 4). The extrudate 15 is then forcibly cooled in air to 250° C. with the dry air 31 enclosed therein, subsequently spontaneously cooled and thereafter sized under tension. Next, the extrudate is allowed to stand at 180° C. for 6 hours for aging. Finally, the sealed end portions 26, 27 of the extrudate 15 are cut off without using any oil or air blow to obtain the desired hollow extrudate of specified size. The other hollow extrudate 16 is prepared in the same manner as above with the exception of using different dies.

Alternatively, the sealed end portions 26, 27 may be cut off later at the site where the extrudate is to be used.

The extrudate has a compact thin oxide coating formed on its inner surface. When the extrudate thus obtained was subjected to a degassing treatment at 150° C. for 24 hours and checked for the degree of vacuum, the outgassing rate was $5\times10^{-13}$ torr.liter/s·cm$^2$.

When a hollow extrudate was prepared in the same manner as above except that the dry air was replaced by water-free pure oxygen having a purity of 100%, a compact thin oxide coating was formed over the inner surface of the extrudate. When the extrudate was then subjected to a degassing treatment at 150° C. for 24 hours and checked for the degree of vacuum, the outgassing rate was improved to $2\times10^{-13}$ torr.liter/s·cm$^2$.

For comparison, a hollow extrudate was prepared in the same manner as above with the exception of supplying a gas mixture comprising 20 vol. % of oxygen and the balance argon. A compact thin oxide coating was formed on the inner surface of the extrudate. When the extrudate was then subjected to a degassing treatment at 150° C. for 24 hours and checked for the degree of vacuum, the outgassing rate was $2\times10^{-13}$ torr-.liter/s·cm$^2$.

Further for comparison, a hollow extrudate was prepared in the same manner as above except that dry air or pure oxygen was not supplied. A porous oxide coating of rough texture was formed on the inner surface of the extrudate. When the extrudate was degassed at 150° C. for 24 hours and checked for the degree of vacuum, the outgassing rate was $5\times10^{-12}$torr.liter/s·cm$^2$.

The present invention may be embodied differently without departing from the spirit and basic features of the invention. Accordingly the embodiments herein disclosed are given for illustrative purposes only and are in no way limitative. It is to be understood that the scope of the invention is defined by the appended claims rather than by the specification and that all alterations and modifications within the definition and scope of the claims are included in the claims.

What is claimed is:

1. A process for producing a hollow shaped aluminum extrudate, comprising the steps of:

extruding aluminum to form a hollow shaped aluminum extrudate and, simultaneously, supplying a gaseous medium consisting essentially of dry air within the hollow shaped aluminum extrudate so as to form an aluminum oxide coating in the absence of water on the inner wall surface of the hollow shaped aluminum extrudate.

2. A process according to claim 1, including sealing the end portions of the hollow shaped aluminum extrudate to retain the dry air within the hollow shaped aluminum extrudate.

3. A process according to claim 1, wherein the dry air has a dew point of up to −30° C.

4. A process according to claim 1, wherein the dry air has a dew point of up to −50° C.

5. A process according to claim 1, wherein the dry air has a dew point of up to −30° C.

6. A process according to claim 2, wherein the dry air has a dew point of up to −50° C.

7. A process for producing a hollow shaped aluminum extrudate, comprising the steps of:

extruding aluminum to form a hollow shaped aluminum extrudate and, simultaneously, supplying a gaseous medium consisting essentially of pure oxygen within the hollow shaped aluminum extrudate so as to form an aluminum oxide coating in the absence of water on the inner wall surface of the hollow shaped aluminum extrudate.

8. A process according to claim 1, including sealing the end portions of the hollow shaped aluminum extrudate to retain the pure oxygen within the hollow shaped aluminum extrudate.

* * * * *

UNITED STATES PATENT AND TRADEMARK OFFICE

CERTIFICATE OF CORRECTION

PATENT NO. : 4,860,565

DATED : August 29, 1989

INVENTOR(S) : Yutaka KATO et al.

It is certified that error appears in the above-identified patent and that said Letters Patent is hereby corrected as shown below:

Column 6, line 14, delete "according to claim 1" and substitute therefor --according to claim 2--.

Signed and Sealed this

Twenty-eighth Day of April, 1992

*Attest:*

HARRY F. MANBECK, JR.

*Attesting Officer*

*Commissioner of Patents and Trademarks*